US006137972A

United States Patent [19]

Playfair et al.

[11] Patent Number: 6,137,972

[45] **Date of Patent: *Oct. 24, 2000**

[54] IMAGING MATERIAL DISPENSING SYSTEM

[75] Inventors: David B. Playfair, Penfield; Frederick A. Philbrick, Walworth; Wayne D. Drinkwater, Fairport; Jan M. Enderle; Michael Harris, both of Rochester, all of N.Y.

[73] Assignee: Xerox Corporation, Stamford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/385,262

[22] Filed: Aug. 30, 1999

[51] Int. Cl.[7] ..... G03G 15/08

[52] U.S. Cl. ..... 399/106; 141/363; 220/270; 222/167; 399/262

[58] Field of Search ..... 399/106, 103, 399/254, 255, 256, 258, 260, 262; 222/DIG. 1, 160, 162, 544, 546, 554, 563; 141/363; 220/350, 270

[56] References Cited

U.S. PATENT DOCUMENTS

| | | | |
|---|---|---|---|
| 4,062,385 | 12/1977 | Katusha et al. | 141/89 |
| 4,611,730 | 9/1986 | Ikesue et al. | 222/167 |
| 5,074,344 | 12/1991 | Vacek et al. | 141/363 |
| 5,089,854 | 2/1992 | Kaieda et al. | 399/262 |
| 5,091,750 | 2/1992 | Yoshida et al. | 399/106 |
| 5,370,270 | 12/1994 | Adams et al. | 141/363 X |
| 5,383,502 | 1/1995 | Fisk et al. | 141/364 |
| 5,613,177 | 3/1997 | Meetze, Jr. et al. | 399/262 X |
| 5,740,506 | 4/1998 | Sundquist et al. | 399/262 |
| 5,890,040 | 3/1999 | Matsuoka et al. | 399/262 |

*Primary Examiner*—Sophia S. Chen

[57] ABSTRACT

A system for dispensing imaging development material into a printer from a re-supplying container dispensing aperture sealed by a sealing plug, which plug is automatically unsealed by the insertion of the container into the printer, and automatically resealed by removal of the container. Simply pushing the container towards its normal position against the imaging material input of the printer (here, a fixed auger tube) first automatically grasps the plug in a gripping system and then pushes the gripped plug into the interior of the container while firmly holding the plug on the end of the auger tube. After the material dispensing, or whenever else the container is removed, simply pulling the container away causes the plug to automatically re-seal the dispensing aperture and then to automatically release the plug gripping system so that the re-sealed container can be cleanly removed. The plug gripping system may be a readily engageable, but only forcibly releasable, gripper on the plug which engages a mating stationary member on the end of the printer auger tube.

8 Claims, 5 Drawing Sheets

IMAGING MATERIAL DISPENSING SYSTEM

Figure 1:
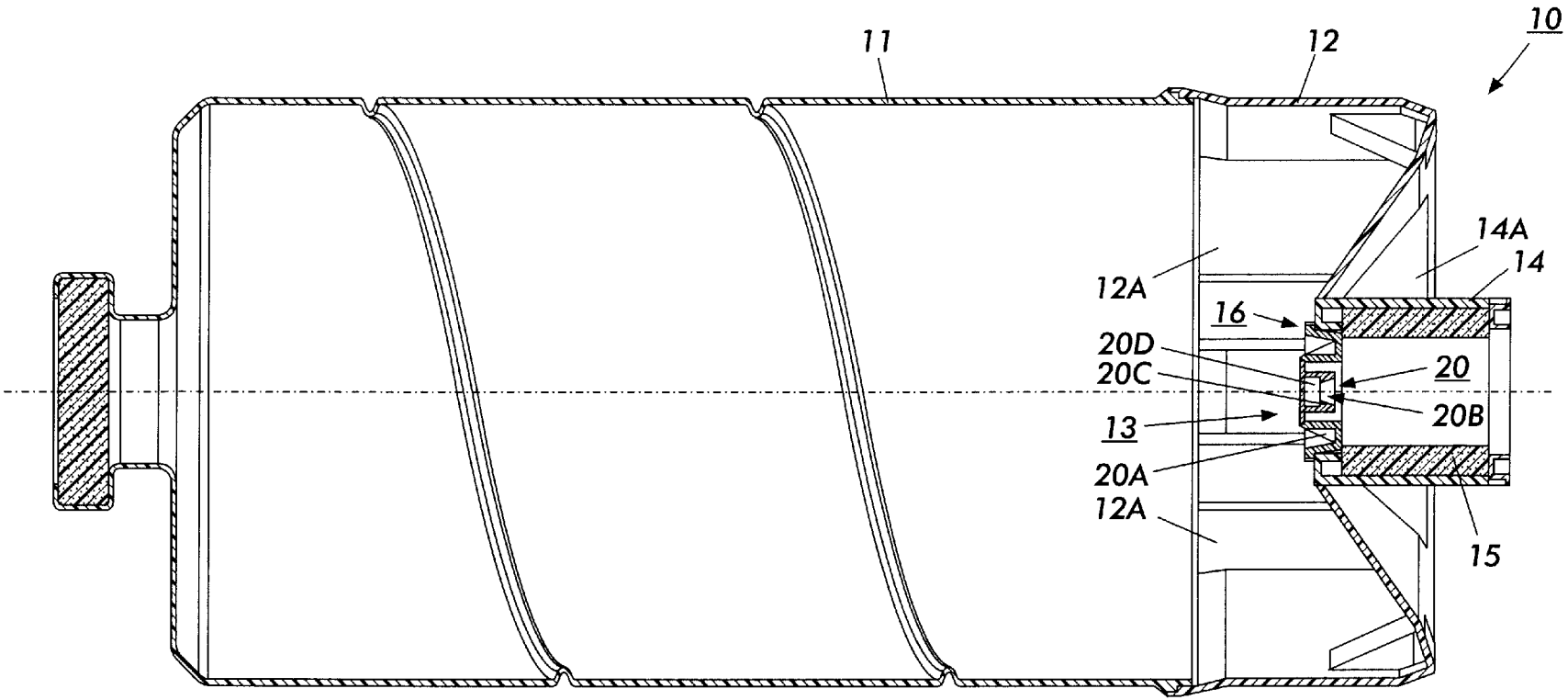

Cross-referenced is a related copending, commonly assigned, application for which this is an alternative and improvement: U.S. patent application Ser. No. 09/347,568, filed Jul. 6, 1999, by Douglas J. Baxendell and Clifford W. Imes IV, entitled "Toner Container."

Disclosed in the embodiments herein is an improved imaging material dispensing system for dispensing toner or other image developer material from an imaging material supply container for a reproduction apparatus such as a xerographic or other printer or copier (although not limited thereto). More specifically, the disclosed system relates to the automatic opening and automatic positive resealing of an imaging materials dispensing port of an image developer material dispensing container for a printing apparatus.

It is desirable that imaging materials, especially loose powder-like dry particulate materials, be easily added to a reproduction apparatus with as little spillage as possible, and with as little contamination of the machine or the user as possible, preferably just by a simple movement of removing one imaging materials supply container and inserting in the same position another such container (rather than pouring loose material from an open container into the printing machine). Also, desirably the imaging material supply container is relatively simple, low-cost, and recycleable.

A typical xerographic or other electrographic printing machine has an imaging surface member on which an electrostatic latent image is formed. The latent image is developed with an image developer material in a developer unit. Generally (but not always) that is a dry developer material comprising very small toner particles. In most cases that is assisted by carrier beads mixed therein. The toner particles are attracted to the latent image to form a visible toner image on the imaging surface. After the electrostatic latent image is so developed with the toner particles, the toner powder image is transferred to a paper or other sheet or web image substrate, directly or indirectly. Thereafter, the toner powder image is typically heated to permanently fuse it to the final image substrate.

As toner is so consumed, it must be replaced. Typically xerographic printing machines use a removable (replaceable) toner container or cartridge from which fresh toner, or toner mixed with carrier, is dispensed into the machine. It is highly desirable that the exchange of these toner cartridges be "white glove." By that it is meant that they are designed so that the operator's hands do not get dirty when they are replacing or exchanging toner cartridges for the printing machine. When the toner cartridge is opened to dispense toner particles into the printing machine, it is also desirable that none of these toner particules escape to contaminate other areas of the printing machine. The toner cartridge must be fully sealed before, and as, it is being placed into the printing machine, and then fully resealed as it is removed therefrom, in order to prevent this kind of toner escape and/or contamination. An "empty" toner container being removed typically still contains substantial loose toner powder.

Typical modern toner replacement cartridges have an opening (aperture) in one end through which the toner is discharged. This toner cartridge aperture mates with an opening in the printing machine so that the toner particles are discharged from the toner cartridge into the printing machine and received in the developer unit thereof. Prior to being placed in the printing machine, the opening in a toner cartridge typically has been covered with a manually removable seal (or extra seal) to insure that toner particles do not escape therefrom during shipment and handling of the cartridge. This requires the operator to learn and perform an additional step for toner replenishment.

Thus, of particular interest to the present invention is Xerox Corporation U.S. Pat. No. 5,383,502 issued Jan. 24, 1995 to Duane H. Fisk and David B. Playfair (D/93500). It discloses a toner dispenser with an automatic lid or cover latching and unlatching system as the toner container is inserted and removed from the reproduction apparatus. Cited therein re that subject matter are U.S. Pat. Nos. 5,074,344; 5,089,854; 5,091,750; 4,062,385; and 4,611,730.

Although the present system is not limited thereto, it is advantageous for use with known cylindrical toner cartridges or "bottles" for printing machines with spiral ribs so that when the toner cartridge is rotated, the spiral ribs urge the toner to the dispensing aperture end thereof. By way of background there is noted U.S. Pat. No. 5,857,129, issued Jan. 5, 1999, to Harris, which discloses such a cylindrical toner cartridge having an opening at one end and integral spiral ribs molded into the container wall so that as the container is rotated about its longitudinal axis, toner particles are advanced to the discharge opening for discharge into the machine (after its seal is removed). Other examples of an internal auger rotating in and with a cylindrical toner dispenser are disclosed in Xerox Corporation U.S. Pat. No. 5,257,077, and U.S. Pat. No. 5,495,323 issued Feb. 27, 1996 to Murray O. Meetze, Jr.

The exemplary cylindrical rotating toner dispensing cartridge, shown by way of one example hereinbelow of an imaging material dispensing system, and its function, and associated apparatus, may be similar in some respects to that of the above-cited patents. They provide examples of known features of only background interest to the present invention, such as the rotatable drive and the integral internal auger for leveling and transporting toner therein to a dispensing outlet to replenish a development unit of a xerographic printer on controlled demand, etc.

These and other such specific developer material dispensing system details need not be redescribed in detail herein. It will also be noted that various of such disclosed and other prior systems required manual removal of seals, or ruptured seals, or flexible foam seals, that do not provide strong, positive, solid re-sealing of a removed developer material container.

As noted, it is desirable to provide a reliable system for replenishing imaging material whenever it needs to be added to a reproduction apparatus which consumes such imaging material during sheet or web printing operations. Various "low toner", toner level or toner presence detecting systems have been developed and/or patented for xerographic copiers and printers which determine when the internal supply source of toner needs to be replenished. They may provide a local (on the machine) or remote user GUI (graphic user display) display of the need for replacing a toner dispensing supply container when the undispensed toner therein approaches a preset low level or near empty state. Some examples include U.S. Pat. Nos. 3,920,155; 4,135,642; and 4,989,754. There are alternative or additional systems for estimating the consumption of toner, as in U.S. Pat. No. 5,349,377 and other references cited therein. It may also be desirable to exchange imaging material supply containers even if they are not depleted in some cases, such as for changing the printing color or other properties requiring a different toner.

The embodiment disclosed herein provides a number of important advantages. The opening and closing of the developer material dispensing container is completely automatic, accomplished cleanly, simply and entirely by the insertion and removal of the container into and out of the printer, with no additional steps by the user. The sealing plug for the dispensing aperture of the container does not even need to ever even handled by the operator. It is unsealed, removed and held inside the container by the printer itself for dispensing, and then resealed from inside the container by the printer whenever the container is removed. That is, the sealing plug is attached to the machine whenever the container is mounted in the machine but is held inside the container. It is not just pushed in, it is gripped and held by the machine. Furthermore, the sealing plug is positively resealed in the dispensing aperture of the container while held by that same grip of the machine.

A specific feature of the specific embodiment disclosed herein is to provide in a dry particulate imaging development material dispensing system, including a dispensing container, for a printing apparatus, wherein said dry particulate imaging material is supplied from said dispensing container, which dispensing container is adapted to engage with said printing apparatus in a defined engagement position for the removal of said dry particulate imaging material from said dispensing container into said printing apparatus, and wherein said dispensing container is also disengageable from said printing apparatus for the replacement of one said dispensing container with another, the improvement comprising: a dispensing aperture in said dispensing container through which said dry particulate imaging material is so supplied from said dispensing container into said printing apparatus, a substantially solid sealing plug, normally sealing said dispensing aperture in said dispensing container to prevent inadvertent escape of said dry particulate imaging development material from said dispensing container, said sealing plug having an integral gripping system, a gripper system integral said printing apparatus positioned in said defined engagement position to engage and grip said sealing plug gripping system as said dispensing container is engaged with said printing apparatus, said gripper system being adapted to grip said gripping system of said sealing plug and to forcibly push said sealing plug inside said dispensing container retaining said sealing plug gripped by said gripper system to open said dispensing aperture of said dispensing container for said supplying of said dry particulate imaging material from said dispensing container into said printing apparatus automatically upon said engagement of said dispensing container with said printing apparatus, said gripper system being adapted to continue to grip said gripping system of said sealing plug until said dispensing container is disengaged from said printing apparatus.

Further specific features disclosed herein, individually or in combination, include those wherein said printing apparauts gripper system is further adapted to automatically reseal said sealing plug in said dispensing aperture in said dispensing container automatically during said disengagement of said dispensing container from said printing apparatus, so, that said sealing plug automatically re-seals said dispensing aperture upon the removal of said dispensing container from said printing apparatus, and to then release said grip of said sealing plug; and/or wherein said sealing plug gripping system has a central expandable snap-lock gripping recess, and wherein said gripper system integral said printing apparatus is in a fixed position and is automatically forced into said snap-lock gripping recess upon the insertion of said dispensing container into said printing apparatus in said defined engagement position; and/or wherein said gripper system integral said printing apparatus is mounted to the outer end of a fixed position hollow developer material removal tube of said printing apparatus which operatively connects with said dispensing aperture of said dispensing container for removing said imaging material from said dispensing container; and/or wherein said printing apparatus has a fixed position hollow developer material removal tube which extends into said dispensing aperture of said dispensing container for removing said imaging material from said dispensing container when said dispensing container is fully engaged with said printing apparatus in said defined engagement position, and wherein said gripper system integral said printing apparatus comprises a pin with an enlarged head mounted to the outer end of said hollow developer material removal tube of said printing apparatus, and wherein said sealing plug is only slightly larger in diameter than, and coaxial with, said hollow developer material removal tube; and/or wherein said dispensing container is generally cylindrical and is rotatably mounted in said printing apparatus when said dispensing container is so engaged with said printing apparatus, and wherein said sealing plug is coaxial said dispensing container at one end of said dispensing container; and/or a method of dispensing a colored imaging development material for a printing apparatus from a dispensing aperture of a re-supplying container of imaging development material into an imaging material input of a printing apparatus, comprising: sealing said dispensing aperture of said re-supplying container with a sealing plug which is only removable to the interior of said re-supplying container, pushing said re-supplying container with said sealing plug against said imaging material input of said printing apparatus to automatically push said sealing plug to the interior of said re-supplying container and thereby open said dispensing aperture for dispensing said imaging development material from said re-supplying container into said imaging material input of said printing apparatus, firmly holding said sealing plug on said imaging material input of said printing apparatus for said dispensing of said imaging development material from said re-supplying container into said imaging material input of said printing apparatus, then pulling said re-supplying container away from said imaging material input of said printing apparatus while still firmly holding said sealing plug on said imaging material input of said printing apparatus until said sealing plug automatically reseals said dispensing aperture of said re-supplying container, then releasing said sealing plug from said imaging material input of said printing apparatus in response to further said pulling of said re-supplying container away from said imaging material input of said printing apparatus; and/or wherein said firmly holding of said sealing plug on said imaging material input of said printing apparatus is accomplished by a readily engageable and forcibly releasable gripping system on said sealing plug and a mating stationary gripper system on said imaging material input of said printing apparatus; and/or wherein said imaging material input of said printing apparatus comprises an extended dry particulate imaging material removal tube coaxial said sealing plug which tube moves partially into said dispensing container.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be re-described here.

Figure 2:
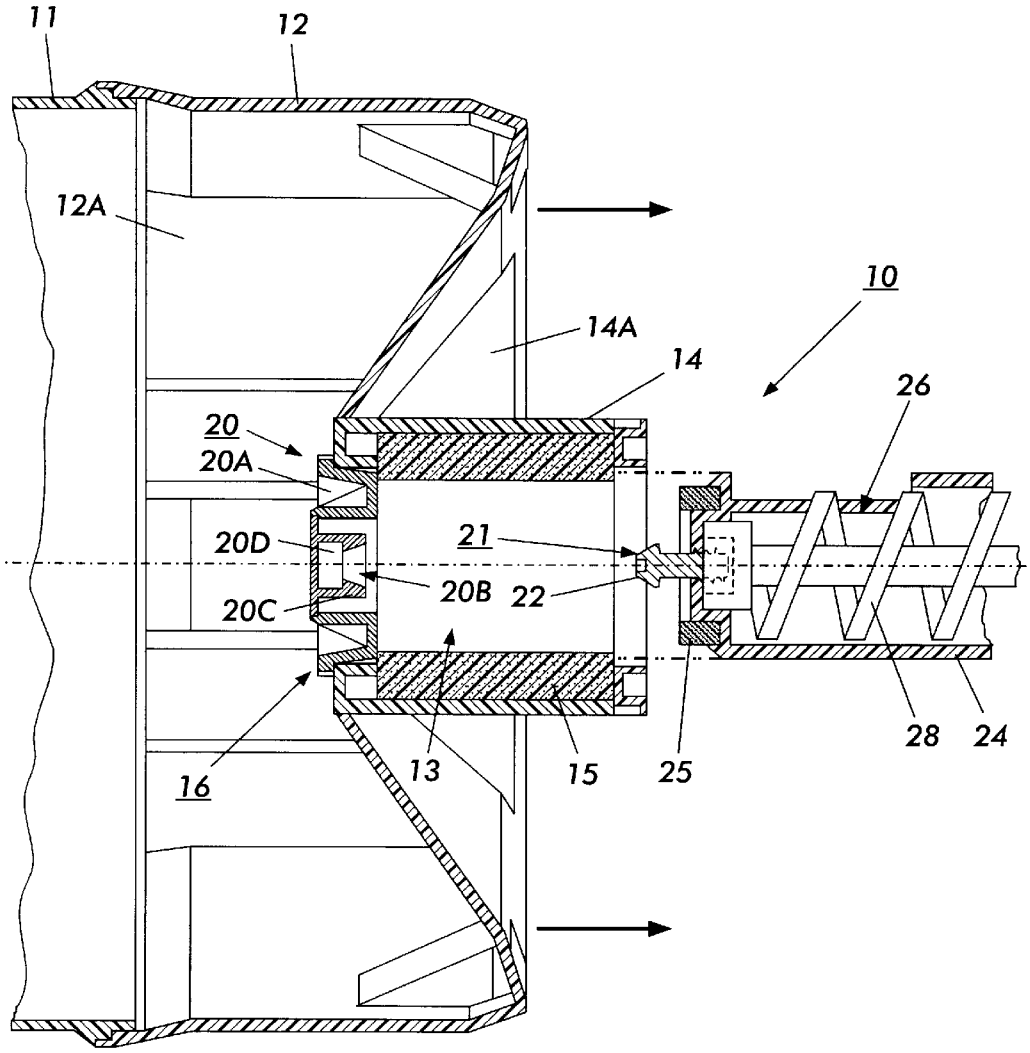
Figure 3:
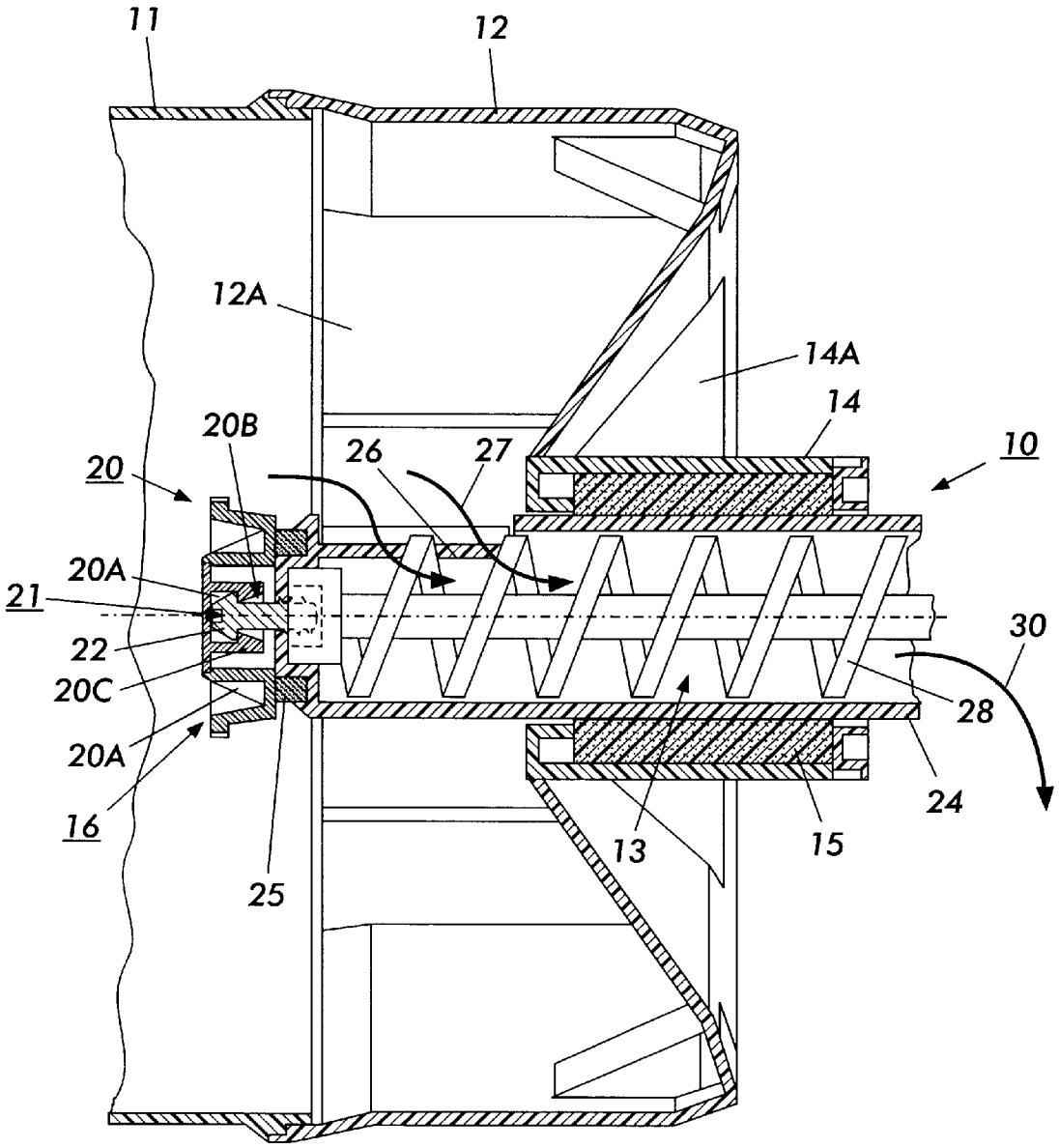
Figure 4:
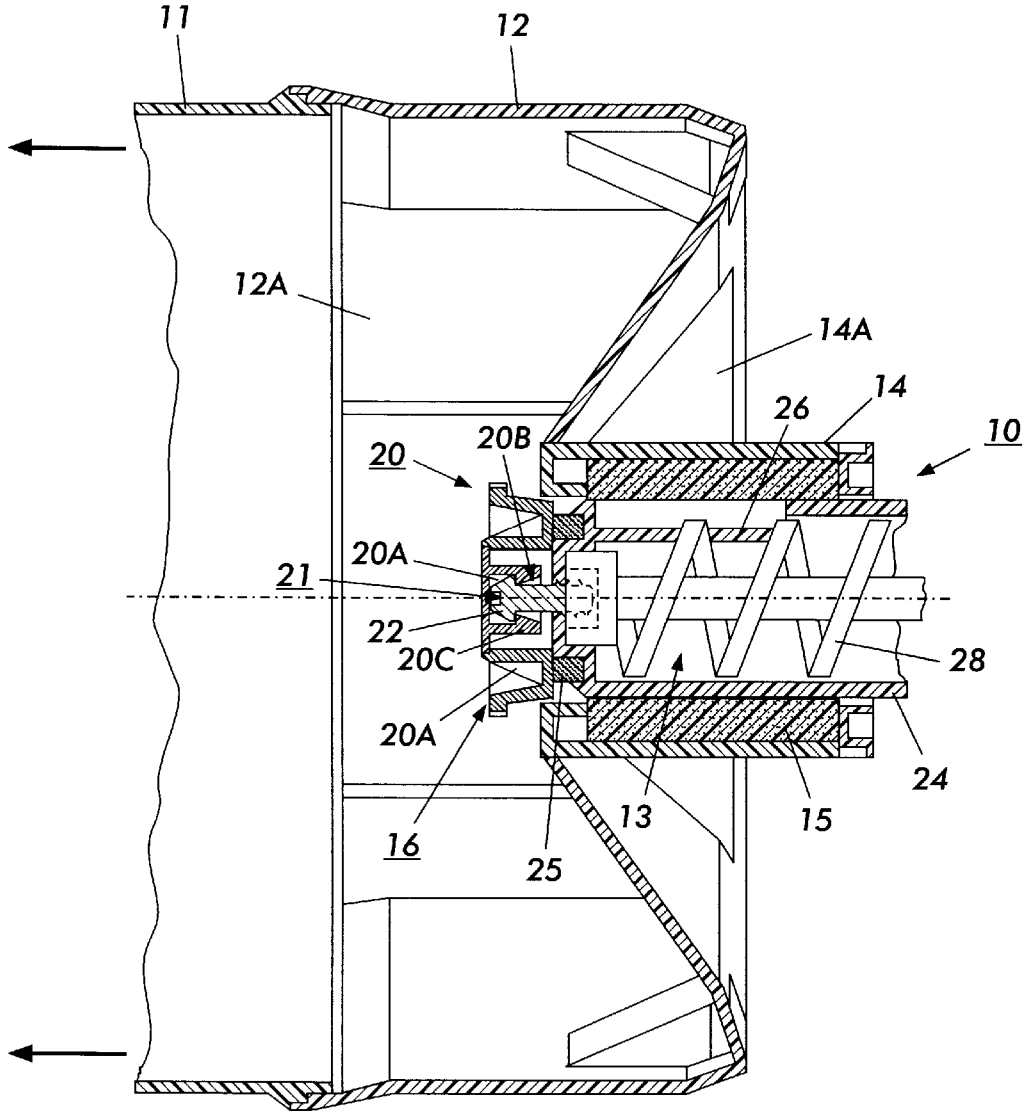
Figure 5:
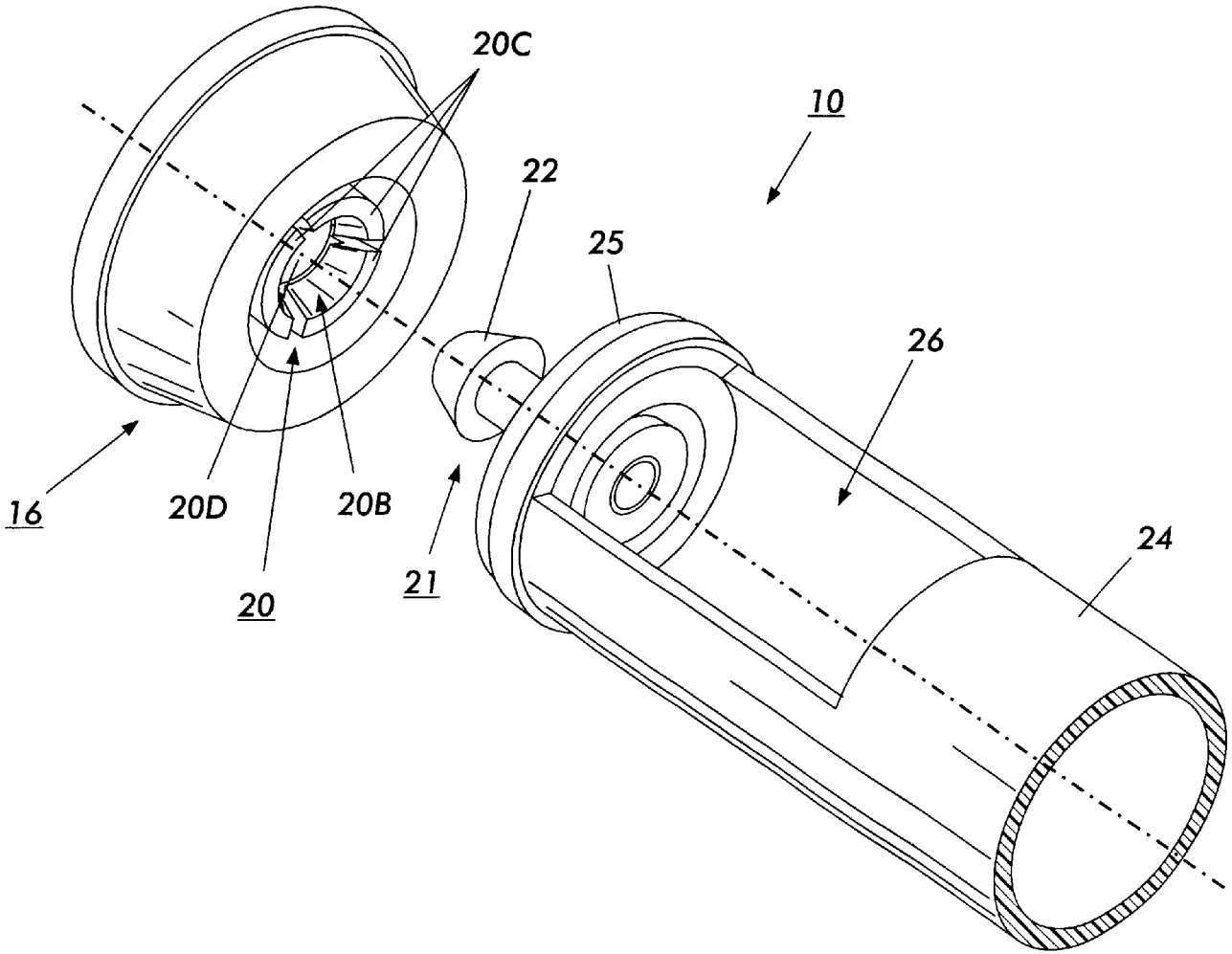

Various of the above-mentioned and further features and advantages will be apparent from the specific apparatus and its operation described or shown in the examples below, and in the claims. Thus, the present invention will be better understood from this description of a specific embodiment, including the drawing figures (approximately to scale) wherein:

FIG. 1 is a central axial cross-sectional view of one exemplary embodiment of one of a plurality of substantially identical readily user-exchangeable developer material dispensing containers which are forming part of an exemplary dry particulate imaging development material (e.g., toner, or toner plus some carrier) dispensing system in accordance with the present invention, particularly showing the exemplary container's removable sealing plug;

FIG. 2 is a an enlarged partial (broken away) view of one end of the exemplary dispensing container of FIG. 1 as it is being inserted into the replacement developer material input of a printing apparatus, shown about to engage (in the direction of the illustrated movement arrows) an example of a novel container engagement and toner removal portion of said printing apparatus (also shown in axial cross section, and also partially broken away);

FIGS. 3 and 4 are essentially the same view as that of FIG. 2, but in different positions of the above mating components, wherein;

FIG. 3 shows the completed insertion of the dispensing container of FIG. 1 onto the printer's developer material input (here, a fixed auger tube system), which (as will be described) has thereby automatically removed, and is still holding, the container plug, and allowing developer material to be removed from the container into the printer, as schematically illustrated by the curved movement arrows;

FIG. 4 shows the removal of an empty or replaced developer material container just before the container plug is about to be automatically re-seated to automatically re-seal the container in this exemplary system; and FIG. 5 is an enlarged perspective partial view of this exemplary system of FIGS. 1–4 for further illustrating in perspective the exemplary components involved in the automatic engagement, removal and reseating of the dispensing aperture sealing plug of the developer material container, in approximately the relative position of FIG. 2.

Describing now in further detail this exemplary embodiment with reference to the FIGS. , there is shown an improved imaging material dispensing system with fully automatic dispensing container opening and resealing. This opening and resealing occurs automatically simply by the customer insertion and removal of this type of dispensing container into and out of a printer having a printer developer material input adapted as described or claimed herein. Since the rest of the printer (reproduction apparatus) may be well known or conventional, as shown by the above-cited and many other references, only that portion of the printer which engages the inserted dispensing container to remove developer material therefrom need be shown and described herein.

Disclosed in the specific embodiment shown herein, as will be further described, is a system to enable positive automatic opening and automatic resealing of a toner dispensing container or bottle via a relatively solid force-fit plug or cap that is uniquely positively held and retained at all times in this system, even when it is removed from the container's dispensing aperture. This sealing plug is the seal for the dispensing aperture of each of the developer material dispensing containers, and is normally and desirably mounted in, and completely sealing, that dispensing aperture of the container except when toner or other developer material is being removed from that container. The imaging material dispensing container may alternatively be referred to in this art as a "toner bottle" or container, even though in this particular embodiment, as per the above citations of examples of patent thereof, it is a rotatable cylinder, and may contain more than toner.

In the disclosed system, as the toner bottle or container is inserted into the printer, a male pin head, which is a fixed component of the printer, is pushed into a plastic sealing plug or cap having a female snap fit gripping feature, as will be further described. The two engage and lock onto each other, firmly securing the plug or cap onto the pin head. As the toner container is further inserted, the plug remains gripped on the end of the pin head, but is pushed inside the toner bottle, allowing removal of the toner. The pug remains so gripped until such time as the toner bottle is removed. Then the plug positively and automatically reseals itself to the toner bottle dispensing aperture when the bottle is retracted, by the forcible holding action of the female snap fit system on the pin head, which releases only after the sealing plug is re-seated. That is, the design of the snap fit gripper and its plastic material on the plug or end cap enables it to remain on the pinhead with ample force for the plug to engage and lock onto the bottle again.

Referring to the FIG. reference numbers, there is shown the exemplary developer material dispensing system 10, comprising, as a first part, the developer material container 11. This container 11 has a large cylindrical tubular body and end cap 12. The end cap 12 may have internal mixing fins 12A. It is centrally recessed, to provide a recessed central (axial) developer material dispensing aperture 13. This aperture 13 is directly connecting with an integral externally extending dispensing tube 14, having support fins 14A. This tube 14 however preferably does not extend beyond the outer dimensions of the end cap 12, i.e. it is substantially within the central recess of the end cap 12. The dispensing tube 14 has a foam tube inner liner seal 15.

Turning now to the exemplary sealing plug unit 16, it is suggested to view it in FIG. 5 first, then to view it in the other FIGS. This sealing plug unit 16 may be a single integral plastic molding, and has an integral central female plug unit gripping system 20. (The central portion of the plug unit 16 may also have integral rear supporting fins such as 20A.) The gripping system 20 here comprises an entrance 20B into a gripping chamber 20D and is defined by three flexible vanes 20C.

The outer periphery of the plug unit 16 is tapered to provide a frictional force fit plug sealing of the aperture 13 of the container 11. It may also be provided with a weak adhesive sealing material. However, it is important to note that, unlike a normal sealing plug, the plug 16 is inserted and removed from, and seals the aperture 13 from, the inside of the container 11. The maximum radius or outer lip shoulder of the plug 16 is larger than the radius of the mating aperture 13, and always inside the container 11. It is installed during manufacture before the end cap 12 is sealed to the rest of the container 11 body. This, the plug 16 cannot be pulled out, or knocked out, of the container 11 from the outside of the container 11, and discarded, displaced or lost, like a normal sealing plug. Nor can the plug 16 be easily manually retrieved from inside the container (especially if it is partially filled with opaque loose powder developer material) to reseal the container if the plug is improperly pushed in by anything other than the intended engagement with the material dispensing system of the printer with which it is designed to engage with, and be gripped by, as further described below.

Turning now to the printer material dispensing system, as shown in the FIGS., and as noted above, only that portion of the printer which engages the inserted dispensing container to remove developer material therefrom need be described herein. That is, only the replacement developer material input of a printing apparatus. In this embodiment, that is a fixed position cylindrical apertured auger tube system. It comprises a machine auger tube 24, having a foam ring end seal 25, which, when fully interconnected with a fully inserted container 11, as in FIG. 3, provides, via the auger tube's toner inlet aperture 26, a toner removal path 27 (see arrows) to an internal auger 28 which feeds the toner out to a toner tube discharge path 30 (arrow). In a known manner, that feeds the developer material into one or more of the printer's image developer systems. The machine auger tube 24 is designed and dimensioned so that as the material container 11 is inserted into the printer in a known manner (guided in by input path defining guides or slides in the printer in a known manner) the machine auger tube 24 is automatically aligned with and enters the dispensing tube 14 and the dispensing aperture 13 of the container 11 until the material inlet aperture 26 (on one side of the auger tube) is fully inside the container. The exterior of the auger tube 24 fits within and is sealed by the tube liner seal 15 of the container dispensing tube 14.

Turning now to the second or fixed part, the printing machine gripper system portion, of the exemplary system for automatically removing, holding, and resealing the sealing plug unit 16, here this entire machine portion of that system is on the end of the machine auger tube 24. As may be seen, it is provided simply by a gripping pin 21, with an enlarged integral gripping pin head 22, which is extending axially from the engagement or extending outer end of the machine auger tube 24. It is surrounded by the foam ring end seal 25. Both engage the plug unit 16 when the container 11 is inserted thereagainst. The start of that insertion movement is shown in FIG. 2.

As described above, the plug unit 16 has a gripping system 20 with an entrance 20B into a gripping chamber 20D defined by three integral stiffly resilient or flexible vanes 20C, all of which taper inwardly, up to a recessed catch lip defining the gripping chamber 20D. The pin head 22 is smaller in diameter than the outer-most or entrance portion of this entrance 20B, but larger in diameter than the inner portion thereof, so as to outwardly flex the vanes 20C by the netering pin head 22 until they snap back as the rear of the enlarged pin head 22 passes their recessed catch lips, and the outer end of the pin head engages the closed end or base of the gripping chamber 20D, so that the pin head 22 is firmly gripped with in the gripping chamber 20D of the plug unit 16. In this engaged position, as shown in FIGS. 3 or 4, the end face of the auger tube 24 is also flushly engaging a surrounding area of the outer face of the plug unit 16. Thus, the entire plug unit 16 is firmly gripped in a fixed position on the (stationary) end of the printer auger tube 24. In that same position, the seal 25 is also engaged with the outer surface of the plug unit 16. The seal 25 is intended to keep toner out of the entire gripping system 20 even when the plug unit 16 is held inside the container 11, as in FIGS. 3 and 4.

As described above, simply by the further (continued, uninterrupted) insertion of the container 11 into the printer (the container 11 movement into the FIG. 3 position) the above-described engagement forces the plug unit 16 to unseal from the dispensing aperture 13, and then continues to force the plug unit 16 further inside the container 11. Yet, because of the above-described gripping system, the plug unit 16 remains firmly held in its fixed position on the end or head of the machine auger tube 24. Thus, as the container 11 is later removed, as shown in FIG. 4, the plug 16 remains held in that position until the container 11 dispensing aperture 13 moves back towards, surrounds, and then re-engages firmly with, the tapered peripheral plug sealing surface of the plug 16, to thus return the system to the fully sealed condition of FIG. 2, so that the removed container 11 will remain so re-sealed as it is fully removed from the printer, as in its original condition in FIG. 1. After the plug is thus forcibly fully re-seated and resealed in the dispensing aperture 13, the further increased force of further removal movement of the container 11 as it is being disengaged from the printer will then cause the pin head 22 to force open the vanes 20C from inside their detents to escape from the gripping chamber 20D to completely release the grip of the sealing plug 16 and separate therefrom. If the detent or catch lips of the vanes 20C are damaged or worn by such separation from the pin head 22, the relatively small and low-cost plastic plug 16 need not be reused again, and can be recycled for its (single) material instead, whereas the pin head 22 is preferably metal and numerous containers 11 can be connected and reconnected therewith without replacement.

Note especially that no internal tubes, springs, or the like, are required inside of, or as a part of, the container 11 to remove, retain, and reseal the container's plug unit 16 in this manner. This is accomplished by simple and permanently usable components of the printing machine itself, together with low cost simple molded plug units. The entire container thus can be quite simple. This particularly lowers the unit manufacturing cost of these replaceable developer material container units, which must be produced in large volumes. The absence of any internal tubes, springs, etc., in the container also avoids interference with the dry particulate toner material flow or mixing therein. It can also makes these containers easier to automatically fill or refill by corresponding automatic filling machine plug removal and reseating mechanisms.

It may also be seen that no extra or complicated customer steps or directions whatsoever are required to accomplish all of the above desirable operations—merely a simple, direct, linear, insertion and removal of the developer material supply container. Nor are any non-recyclable throw-away seals required. Yet, as shown, the container body itself may be a simple rotatable cylindrical tube, compatible with existing rotatable dispensing systems with wall-molded augers as described above.

In summary, the opening and closing of this exemplary developer material dispensing container is completely automatic. It is accomplished cleanly, simply and entirely by the insertion and removal of the container into and out of the printer, with no additional steps or concerns by the user. The sealing plug for the dispensing aperture of the container never even needs to be touched by any printer operator. That sealing plug is unsealed and held inside the container by the printer itself for all material dispensing, and then resealed from inside the container by the printer whenever the container is removed. That is, the sealing plug is attached to the machine whenever the container is mounted in the machine, and positively held inside the dispensing container by the machine. The sealing plug is not just pushed in, it is gripped and held by the machine. Furthermore, the sealing plug is positively resealed in the dispensing aperture of the container while held by that same grip of the machine.

While the embodiment disclosed herein is preferred, it will be appreciated from this teaching that various alternatives, modifications, variations or improvements therein may be made by those skilled in the art, which are intended to be encompassed by the following claims.

What is claimed is:

1. In a dry particulate imaging material dispensing system, including a dispensing container, for a printing apparatus, wherein said dry particulate imaging material is supplied from said dispensing container, which dispensing container is adapted to engage with said printing apparatus in a defined engagement position for the removal of said dry particulate imaging material from said dispensing container into said printing apparatus, and wherein said dispensing container is also disengageable from said printing apparatus for the replacement of one said dispensing container with another, the improvement comprising:

a dispensing aperture in said dispensing container through which said dry particulate imaging material is so supplied from said dispensing container into said printing apparatus, a sealing plug, normally sealing said dispensing aperture in said dispensing container to prevent inadvertent escape of said dry particulate imaging development material from said dispensing container, said sealing plug having an integral gripping system, a gripper system integral said printing apparatus positioned in said defined engagement position to engage and grip said sealing plug gripping system as said dispensing container is engaged with said printing apparatus, said gripper system being adapted to grip said gripping system of said sealing plug and to forcibly push said sealing plug inside said dispensing container while retaining said sealing plug gripped by said gripper system to open said dispensing aperture of said dispensing container for said supplying of said dry particulate imaging material from said dispensing container into said printing apparatus automatically upon said engagement of said dispensing container with said printing apparatus, said gripper system being adapted to continue to grip said gripping system of said sealing plug until said dispensing container is disengaged from said printing apparatus;

wherein said sealing plug has a defined internal diameter, and wherein said integral sealing plug gripping system is centrally spaced inside of and out of contact with said defined internal diameter of said sealing plug, and wherein said integral sealing plug gripping system comprises an expandable snap-lock gripping recess defined by expandable gripper fingers and wherein said gripper system integral said printing apparatus is in a fixed position and is automatically forced into said snap-lock gripping recess by expanding said gripper fingers upon the insertion of said dispensing container into said printing apparatus in said defined engagement position to snap-lock said sealing plug to said gripper system before said sealing plug is forcibly pushed inside said dispensing container.

2. The dry particulate imaging material dispensing system of claim 1, wherein said printing apparauts gripper system is further adapted to automatically reseal said sealing plug in said dispensing aperture in said dispensing container automatically during said disengagement of said dispensing container from said printing apparatus, so that said sealing plug automatically re-seals said dispensing aperture upon the removal of said dispensing container from said printing apparatus, and to then release said grip of said sealing plug.

3. The dry particulate imaging material dispensing system of claim 1, wherein said gripper system integral said printing apparatus is mounted to an outer end of a fixed position hollow developer material removal tube of said printing apparatus which operatively connects with said dispensing aperture of said dispensing container for removing said imaging material from said dispensing container.

4. The dry particulate imaging material dispensing system of claim 1, wherein said printing apparatus has a fixed position hollow developer material removal tube which extends into said dispensing aperture of said dispensing container for removing said imaging material from said dispensing container when said dispensing container is fully engaged with said printing apparatus in said defined engagement position, and wherein said gripper system integral said printing apparatus comprises a pin with an enlarged head mounted to an outer end of said hollow developer material removal tube of said printing apparatus, and wherein said sealing plug is only slightly larger in diameter than, and coaxial with, said hollow developer material removal tube.

5. The dry particulate imaging material dispensing system of claim 1, wherein said dispensing container is generally cylindrical and is rotatably mounted in said printing apparatus when said dispensing container is so engaged with said printing apparatus, and wherein said sealing plug is coaxial said dispensing container at one end of said dispensing container.

6. A method of dispensing a colored imaging development material for a printing apparatus from a dispensing aperture of a re-supplying container of imaging development material into an imaging material input of a printing apparatus, comprising;

sealing said dispensing aperture of said re-supplying container with a sealing plug which is only removable to the interior of said re-supplying container, pushing said re-supplying container with said sealing plug against said imaging material input of said printing apparatus to automatically push said sealing plug to the interior of said re-supplying container and thereby open said dispensing aperture for dispensing said imaging development material from said re-supplying container into said imaging material input of said printing apparatus, firmly holding said sealing plug on said imaging material input of said printing apparatus for said dispensing of said imaging development material from said re-supplying container into said imaging material input of said printing apparatus, then pulling said re-supplying container away from said imaging material input of said printing apparatus while still firmly holding said sealing plug on said imaging material input of said printing apparatus until said sealing plug automatically re-seals said dispensing aperture of said re-supplying container, then releasing said sealing plug from said imaging material input of said printing apparatus in response to further said pulling of said re-supplying container away from said imaging material input of said printing apparatus;

wherein said sealing plug has a defined internal diameter, and wherein said sealing plug has a integral sealing plug gripping system centrally spaced inside of and out of contact with said defined internal diameter of said sealing plug and comprising an expandable snap-lock gripping recess defined by expandable gripper fingers and wherein said imaging material input of said printing apparatus is in a fixed position and is automatically forced into said snap-lock gripping recess by expanding said gripper fingers outwardly towards, but remaining spaced from, said internal diameter of said sealing plug, upon the initial insertion of said re-supplying container into said printing apparatus, so as to snap-lock said sealing plug to said imaging material input of said printing apparatus by expansion of said expandable gripper fingers before said sealing plug is pushed into the interior of said re-supplying container.

7. The method of dispensing a colored imaging development material for a printing apparatus of claim 6, wherein said firmly holding of said sealing plug on said imaging material input of said printing apparatus is accomplished by a readily engageable but only forcibly releasable said snap-lock gripping system on said sealing plug engaging a mating stationary gripper system on said imaging material input of said printing apparatus.

8. The method of dispensing a colored imaging development material for a printing apparatus of claim 6, wherein said imaging material input of said printing apparatus comprises an extended dry particulate imaging material removal tube coaxial said sealing plug which tube moves partially into said dispensing container.

* * * * *